US005286274A

United States Patent [19]

Lindkvist et al.

[11] Patent Number: 5,286,274

[45] Date of Patent: Feb. 15, 1994

[54] METHOD FOR TREATMENT OF POTLINING RESIDUE FROM PRIMARY ALUMINIUM SMELTERS

[75] Inventors: Jon G. Lindkvist, Oslo; Terje Johnsen, Vanse, both of Norway

[73] Assignee: Elkem Technology a/s, Norway

[21] Appl. No.: 971,054

[22] Filed: Nov. 3, 1992

[30] Foreign Application Priority Data

Nov. 7, 1991 [NO] Norway ..... 914352

[51] Int. Cl.[5] ..... C22B 21/00

[52] U.S. Cl. ..... 75/10.48; 75/672; 75/674

[58] Field of Search ..... 75/10.48, 672, 674

[56] References Cited

U.S. PATENT DOCUMENTS

| | | | |
|---|---|---|---|
| 4,030,914 | 6/1977 | Papafingos | 75/672 |
| 4,053,375 | 10/1977 | Roberts et al. | 204/67 |
| 4,113,832 | 9/1978 | Bell et al. | 423/119 |
| 4,444,740 | 4/1984 | Snodgrass et al. | 423/483 |
| 4,735,784 | 4/1988 | Davis et al. | 423/111 |
| 5,024,822 | 6/1991 | Hittner et al. | 423/111 |

FOREIGN PATENT DOCUMENTS

| | | |
|---|---|---|
| 0294300 | 12/1988 | European Pat. Off. . |
| 0307107 | 3/1989 | European Pat. Off. . |
| 912121 | 6/1991 | Norway . |
| 9013774 | 11/1990 | World Int. Prop. O. . |

OTHER PUBLICATIONS

Abstract, Nov. 1985, Section Ch. Week 8622, Derwent Publications Ltd., London, GB, Class C, AN 86-143075 & SU-A-1 189 883 (Zhdanov Metal Inst) 7.

*Journal of Metals* Jul. 1984, New York, pp. 22-32 L. C. Blayden et al. "Spent potlining symposium".

*Primary Examiner*—Peter D. Rosenberg

*Attorney, Agent, or Firm*—Lucas & Just

[57] ABSTRACT

This is a method for treatment of spent potlining from aluminium reduction cells including the refractory material in order to transfer the spent potlining to a form in which it can be used as a filler or as a raw material. The spent potlining is crushed and supplied to a closed electrothermic smelting furnace optionally together with a $SiO_2$ source, wherein the spent potlining is melted at a temperature between 1300° and 1750° C. An oxidation agent is supplied to the furnace in order to oxidize carbon and other oxidizable components contained in the spent potlining such as metals, carbides and nitrides. Further, a source of calcium oxide is supplied to the smelting furnace in an amount necessary to react with all fluoride present to form $CaF_2$ and to form a calcium aluminate or calcium aluminate silicate slag containing $CaF_2$ which slag is liquid at the bath temperature in the furnace, and that the calcium aluminate or calcium aluminate silicate slag and optionally a metal phase are tapped from the furnace and cooled to blocks or granules.

20 Claims, No Drawings

METHOD FOR TREATMENT OF POTLINING RESIDUE FROM PRIMARY ALUMINIUM SMELTERS

The present invention relates to a method for treatment of potlining residue from primary aluminium smelters whereby the content of the residue is brought into such a form that it can freely be used as filler material, for example for roadbuilding or as a raw material for production of other products.

Commercially, aluminium is produced by molten salt electrolysis of aluminium oxide solved in a molten electrolyte which mainly consists of cryolite and aluminium fluoride. The electrolysis is carried out in electrolytic reduction cells where aluminium oxide is dissolved in the molten cryolite bath and reduced to aluminium. The produced aluminium has a higher density than the molten electrolyte and forms a molten layer on the bottom of the reduction cell which functions as the cathode of the cell. As anodes the present invention uses carbon blocks which extend down into the molten bath from above.

The reduction cells which act as cathodes, are lined with carbon blocks or rammed carbon paste facing the molten electrolyte and have a lining of refractory material between the cathode outer steel shell and the carbon lining. The refractory lining is normally made from chamotte bricks with varying content of $SiO_2$. During operation of the electrolytic reduction cells the carbon lining and the refractory lining are degraded due to penetration of bath materials such as aluminium, cryolite, aluminium oxide and other reaction products.

Due to its content of fluorides and cyanide, spent potlining (SPL) from cathodes of aluminium reduction cells is in more and more countries classified as a hazardous waste which is not allowed to be deposited on normal deposits. There have been proposed a number of methods for treatment of the carbon part of SPL in order to recover fluorides and to transfer the rest to such a form that it can be safely deposited.

One method involves pyrohydrolysis in a fluidized bed reactor of the carbon part of SPL. In this process a fluidized bed containing particles of SPL is contacted by water or steam which reacts with fluorides and forms hydrogen fluoride which is recovered.

It is further known to use calcium oxide or calcium carbonate to react with fluorides in SPL at temperature of 700° C. to 780° C. to form calcium fluoride. The remaining product from this process contains, however, still a high level of leachable fluorides.

From U.S. Pat. Nos. 4,113,832 and 4,444,740 is known hydrometallurgical methods for treatment of SPL where the spent potlining material is subjected to an alkaline leaching process and where dissolved fluorides are recovered from the leach solution. These hydrometallurgical methods which aim at recovering fluorides, are however not economical viable due to the complexity of the processes and due to the fact that it is difficult to remove fluorine to a sufficient extent from the starting materials and from the different aqueous process streams which are produced in the processes.

From U.S. Pat. No. 5,024,822 is known a method where the carbon part of spent potlining is treated in a two step process where the spent potlining in a first step is heated to a temperature between 800° and 850° C. under oxygen supply in order to combust the main part of carbon without producing substantial amounts of fluorine containing gases and where the solid material from the first step is mixed with a $SiO_2$ containing material and heated to a temperature of about 1100° C., thereby forming a glassy slag containing fluorine and sodium in the form of silicate compounds with a low leachability in water. The method according to U.S. Pat. No. 5,024,822 has, however, the disadvantage that only the carbon part of the spent potlining is treated. The refractory material has to be removed from the SPL before the treatment. Further this known method has the disadvantage of being a two-step process, wherein the first step has to be carefully controlled in order to prevent formation of fluorine-containing gases.

By the present invention it is provided a single step method for treatment of spent potlining from aluminium reduction cells where the complete potlining including the refractory material, is treated and wherein the spent potlining is transferred to such a form that it can be used as a filler material, for example for road building, or it can be used as steel furnace slag or as a raw material for production of refractory material.

Accordingly, the present invention relates to a method for treatment of spent potlining from aluminium reduction cells in order to transfer the spent potlining to a form in which it can be used as a filler material, which method comprises crushing spent potlining including refractory material, optionally together with a $SiO_2$ material, supply of the crushed material to a closed electrothermic smelting furnace wherein the spent potlining is melted at a temperature between 1300° and 1750° C., supply of oxidation agent to the furnace in order to oxidize carbon and other oxidizable components contained in the spent potlining such as metals, carbides and nitrides, supplying a source of calcium oxide to the smelting furnace in an amount necessary to react with all fluoride present to form $CaF_2$ and to form a calcium aluminate or a calcium aluminate silicate slag containing $CaF_2$ which slag is liquid at the bath temperature in the furnace, and that the calcium aluminate or calcium aluminate silicate slag and optionally a metal phase are tapped from the furnace, whereafter the slag is cooled to blocks or granules.

According to a preferred embodiment, the temperature in the smelting furnace is kept between 1400° and 1700° C.

As oxidation agent any suitable oxidation agent can be used. It is, however, preferred to use iron ore or iron ore pellets as oxidation agents. Other preferable oxidation agents are manganese oxide and other metal oxides such as slag from the production of ferromanganese, manganese ore and chromium oxide ore. Further, oxygen, air or oxygen enriched air can be used as oxidation agents.

When metal oxides are used as oxidation agents for oxidizing carbon and other oxidizable components of the spent potlining, a metal phase will be formed in the smelting furnace. This metal phase will contain a greater part of heavy metals contained in the spent potlining. The metal phase is tapped from the smelting furnace at intervals and can be deposited or sold.

As a source for calcium oxide it is preferably used CaO, $CaCO_3$ or dolomite. Calcium rich wastes like calcium carbide sludge can also be used as a calcium source.

The off gas from the closed smelting furnace is preferably forwarded to a burner where the gas is combusted by supply of air or oxygen. During this combustion any organic compounds such as cyanide will be destructed.

The $CaF_2$ containing calcium aluminate or calcium aluminate silicate slag which is formed, is very aggressive towards refractory lining. It is therefore preferably used a smelting furnace wherein the furnace side walls are equipped with cooling devices which makes it possible to build up a lining of frozen slag on the sidewalls of the furnace.

The method according to the present invention is simple and economically viable, as the complete spent potlining can be treated by the method without other pretreatment than crushing to a suitable particle size. At the high temperatures that exist in the smelting furnace and in the CO-rich gas atmosphere, cyanides and other organic compounds present in the spent potlining will be evaporated and destructed during burning of the CO-rich off-gas from the furnace. The calcium aluminate or calcium aluminate silicate slag which contains $CaF_2$ can be used as a synthetic slag for steel refining, as a raw material for production of cement and for production of refractory blocks.

Tests have shown that the leachability of fluorine from the slag produced by the method of the present invention is low and satisfies the requirements which today are set to fluorine leachability in most countries.

EXAMPLE 1

Spent potlining from an aluminium reduction cell having a chemical analysis as shown in Table 1, was treated by the method according to the present invention.

TABLE 1

| Chemical analysis for SPL | % by weight |
|---|---|
| Carbon | 27.6% |
| $Na_3AlF_6$ | 32.0% |
| $Al_2O_3$ | 13.0% |
| $SiO_2$ | 12.8% |
| Al, Fe, Mg | 14.6% |

In a 50 KW single phase electrothermic smelting furnace equipped with a graphite electrode there was provided a molten slag bath comprising 3 kg CaO, 2.5 kg $Al_2O_3$ and 1 kg of slag from ferromanganese production. The molten slag was kept at a temperature of 1600° C.

The slag from production of ferromanganese was of the following composition in % by weight: 40.8% MnO, 16.7% CaO, 10.8% $Al_2O_3$, 25.3% $SiO_2$ and 4.6% MgO.

To the molten slag bath it was added batches consisting of 1 kg SPL, 0.8 kg ferromanganese slag and 0.3 kg calcium oxide.

From the smelting furnace it was tapped a slag phase and a metal phase. The produced slag phase and metal phase had chemical compositions as shown in Tables 2 and 3.

TABLE 2

| Chemical analysis of produced slag. | % by weight |
|---|---|
| $Al_2O_3$ | 39.3 |
| CaO | 28.2 |
| $CaF_2$ | 11.3 |
| $SiO_2$ | 10.5 |
| $Na_2O$ | 5.9 |
| MgO | 2.7 |

TABLE 2-continued

| Chemical analysis of produced slag. | % by weight |
|---|---|
| MnO | 0.4 |

TABLE 3

| Chemical analysis of produced metal phase. | % by weight |
|---|---|
| Mn | 38.4 |
| Fe | 28.0 |
| Al | 9.8 |
| Si | 14.8 |
| Ca | 0.2 |
| C | 0.8 |

It can be seen from Table 2 that the fluoride content of SPL has been fixed in the slag in the form of $CaF_2$. This is a stable mineral which is substantially not leachable in water. It can further be seen from Table 2 that the sodium content of the SPL has been fixated in the produced slag.

From Table 3 it is evident that the produced metal phase contains substantially all of the supplied manganese and iron in addition to aluminium present in the SPL.

A sample of the produced slag was subjected to a leaching test according to the following procedure: 5.7 ml HOAc (glacial acetic acid) was added to 500 ml distilled water. Thereafter 64.3 ml/N NaOH was added. This mixture was thereafter diluted with water to a volume of 1 liter. After leaching of the slag sample in this solution, the solid residue was filtrated from the leach solution whereafter the leach solution was analysed for heavy metals. The results are shown in Table 4.

TABLE 4

| Results from leaching of produced slag. | |
|---|---|
| Element | mg/l |
| Cr | <5.0 |
| Se | <1.0 |
| Ag | <5.0 |
| Cd | <1.0 |
| Ba | <100 |
| Hg | <0.2 |
| Pb | <5.0 |
| As | <5.0 |

The results in table 4 show that the produced slag complies with the requirements which are set to such materials in order that the materials are not listed as hazardous waste.

EXAMPLE 2

In a 100 KW electrothermic smelting furnace equipped with two top electrodes it was melted batches consisting of 36 kg SPL, 44 kg of iron oxide pellets and 20 kg lime. The spent potlining was of the same composition as shown in table 1 in example 1. During a 6-hour run it was supplied a total charge of 390 kg. From the smelting furnace it was tapped 220 kg oxidic slag. Samples were drawn from the produced slag and chemical analysis of the slag samples were made. The chemical analysis on elemental basis are shown in table 5.

TABLE 5

| Elemental analysis of slag samples. | |
|---|---|
| Element | % by weight |
| Al | 10.4–16.7 |
| Ca | 21.0–21.6 |
| F | 5.0–6.0 |
| Si | 7.8–10.3 |
| Na | 7.4–8.0 |
| Fe | 3.9–4.6 |

The fluorine in the slag was fixed as $CaF_2$.

From the smelting furnace it was further tapped a metal phase which substantially contained iron.

A sample of the produced slag was subjected to a leaching test following the procedure described in example 1. The results are shown in table 6.

TABLE 6

| Results from leaching test of produced slag. | |
|---|---|
| Element | mg/l |
| Ni | <5.0 |
| Cr | <5.0 |
| Se | <5.0 |
| Cd | <1.0 |
| Ba | <100 |
| Hg | <0.2 |
| As | <5.0 |

The results in table 1 show that the produced slag satisfies the requirements set to materials which are not listed as hazardous waste.

Three samples of the slag produced were tested for leachability of fluorine using the same leaching procedure as described above. The following results were obtained:

| | |
|---|---|
| Sample 1 | 61.4 mg/l F |
| Sample 2 | 24.3 mg/l F |
| Sample 3 | 26.9 mg/l F |

The results show that very low values are obtained for fluorine leachabilities from the slag produced by the method of the present invention.

EXAMPLE 3

In the same smelting furnace as used in Example 2 it was smelted 490 kg of a charge consisting of 32 kg SPL, 39 kg iron oxide pellets and 24 kg lime stone, $CaCO_3$. From the smelting furnace it was tapped 68 kg oxidic slag. Samples was drawn from the slag and chemical analysis was made.

TABLE 7

| Elemental analysis of slag samples. | |
|---|---|
| Element | % by weight |
| Al | 8.6–10.9 |
| Ca | 25.7–29 |
| F | 5.7–7.3 |
| Si | 8.5–9.0 |
| Na | 9.2–11.4 |
| Fe | 3.3–6.9 |

The fluorine was fixed as $CaF_2$ in the slag.

A sample of the produced slag was subjected to a leaching test following the procedure described in example 1. The results are shown in table 8.

TABLE 8

| Results from leaching test of produced slag. | |
|---|---|
| Element | mg/l |
| Ni | <5.0 |
| Cr | <5.0 |
| Se | <5.0 |
| Cd | <1.0 |
| Ba | <100 |
| Hg | <0.2 |
| As | <5.0 |

Five samples of the slag produced were also tested for leachability of fluorine. The same procedure as described in example 1 was used for leaching. The following results were obtained:

| | |
|---|---|
| Sample 1 | 217 mg/l F |
| Sample 2 | 69.1 mg/l F |
| Sample 3 | 23 mg/l F |
| Sample 4 | 30.4 mg/l F |
| Sample 5 | 26.8 mg/l F |

The results show that except for Sample 1, excellent results were obtained as regards the leachability of fluorine.

EXAMPLE 4

In the same smelting furnace as used in example 2 and 3 it was smelted 665 kg of a charge consisting of 265 kg SPL, 222 kg iron oxide pellets, 112 kg silica sand and 65 kg burnt lime. The charge was supplied in batches containing an increasing amount of sand. A total of 420 kg slag having three different levels of $SiO_2$ was tapped from the furnace. Samples were drawn from the slags and chemical analyses were made. The results are shown in table 9.

TABLE 9

| Elemental analysis of slag samples. | | | |
|---|---|---|---|
| Element | Slag 1 % by weight | Slag 2 % by weight | Slag 3 % by weight |
| Al | 8.6 | 8.2 | 7.8 |
| Ca | 11.9 | 10.7 | 9.5 |
| F | 7.5 | 7.0 | 6.5 |
| Si | 15.4 | 18.3 | 20.2 |
| Na | 13.4 | 12.7 | 12.2 |
| Fe | 4.9 | 3.8 | 3.6 |

Microscopic analysis of the three slag samples showed that the fluorine was fixed as $CaF_2$.

For each of the tapping of slag it was drawn one sample of slowly cooled slag and one sample of rapidly cooled slag. The six samples were subjected to a test for establishing the leachability of fluorine. The test was carried out using the leaching procedure described in example 1. The results are shown in table 10.

TABLE 10

| Fluorine leaching test. | | | |
|---|---|---|---|
| | Slag 1 F mg/l | Slag 2 F mg/l | Slag 3 F mg/l |
| Slowly cooled | 13.6 | 25.7 | 6.87 |
| Rapidly cooled | 15.7 | 6.77 | 8.70 |

The results in table 10 show that the leachability of fluorine for all samples was very low for both slowly cooled and rapidly cooled slag. It further seems that the rapidly cooled slag shows a somewhat lower leachability for fluorine than slowly cooled slag. Finally, it seems that increasing silicate content in the slag lowers the leachability of fluorine.

We claim:

1. A method for treating a spent potliner from a furnace used for electrolytic smelting of aluminum comprising the steps of:

a) melting crushed spent potliner from said aluminum smelting furnace in a closed electrothermal furnace at a temperature of about 1300° C. to about 1750° C. to form a melt, said spent potliner comprising solid carbon and refractory material, said melt comprising aluminum, fluoride and carbon;

b) supplying an oxidizing agent to said melt to oxidize the carbon and other oxidizable components present in said melt; and c) supplying a source of calcium oxide to said melt in an amount to react with all the fluoride present in said melt and form calcium fluoride and to form calcium aluminate slag or calcium aluminate silicate slag, said slag containing said calcium fluoride formed in said melt.

2. The method of claim 1 further comprising the step of supplying a source of silicon dioxide to said melt.

3. The method of claim 1 further comprising the steps of: tapping said closed electrothermal furnace to remove said calcium aluminate slag or calcium aluminate silicate slag; and cooling said slag tapped from said furnace to form blocks or granules therefrom.

4. The method of claim 1 wherein said oxidizing agent is a metal oxide and a metal phase is formed in said melt; and said method further comprises the step of tapping said closed electrothermal furnace to remove said metal phase.

5. The method of claim 1 wherein the temperature in the closed electrothermal furnace is about 1400° C. to about 1700° C.

6. The method of claim 1 wherein said oxidizing agent is a metal oxide.

7. The method of claim 6 wherein the metal oxide is selected from the group consisting of iron ore, manganese ore and chromium ore.

8. The method of claim 6 wherein the metal oxide is slag from the production of ferromanganese.

9. The method of claim 1 wherein the oxidizing agent is oxygen or oxygen enriched air.

10. The method of claim 1 wherein the source of calcium oxide is calcium oxide or calcium carbonate.

11. The method of claim 1 wherein the source of calcium oxide is dolomite.

12. The method of claim 1 wherein the source of calcium oxide is a calcium containing waste.

13. The method of claim 1 wherein an off-gas is generated in said closed electrothermal furnace; and said method further comprising the step of burning said off-gases from said closed electrothermal furnace in a burner to destroy cyanide and other organic compounds in said off-gas and to convert carbon monoxide in said off-gas to carbon dioxide.

14. The method of claim 1 further comprising the step of cooling the side walls of said closed electrothermal furnace.

15. A method for treating spent potliner from a furnace used for electrolytic smelting aluminum to form an inert material suitable as a filler material, said method comprising the steps of:

(a) crushing spent potliner from an aluminum smelting furnace, said potliner comprising solid carbon and refractory material;

(b) melting said crushed spent potliner in a closed electrothermic furnace at a temperature between about 1300° C. to about 1750° C. to produce a melt comprising aluminum, fluoride, and carbon;

(c) supplying a metal oxide oxidizing agent to said melt to oxidize said carbon in said melt and form a carbon monoxide rich atmosphere above said melt and to form a metal phase in said melt;

(d) supplying a source of calcium oxide to said melt in an amount necessary to react with all said fluoride present in said melt and form calcium fluoride, and to form a calcium aluminate slag or a calcium aluminate silicate slag, said calcium fluoride being present in said slag, said slag being a liquid in said melt;

(e) tapping said closed electrothermal furnace to remove said slag from said furnace;

(f) tapping said closed electrothermal furnace to remove said metal phase; and (g) cooling said tapped slag to form an inert material suitable as a filler material.

16. The process of claim 15 further comprising the steps of:

removing said carbon monoxide rich atmosphere from said closed electrothermal furnace as an off-gas of said closed electrothermal furnace; and burning said off-gas in a burner to convert said carbon monoxide to carbon dioxide and to destroy cyanide and other organic compounds in said off-gas.

17. The process of claim 15 further comprising the step of: cooling the side walls of said closed electrothermal furnace to build up a lining of frozen slag on the inside walls of said closed electrothermal furnace.

18. The process of claim 15 further comprising the step of: supplying a source of silicon dioxide to said closed electrothermal furnace.

19. The process of claim 15 wherein the metal oxide oxidizing agent is selected from the group consisting of: iron ore, manganese oxide, manganese ore, chromium ore, and slag from the production of ferromanganese.

20. The process of claim 15 wherein the source of calcium oxide is selected from the group consisting of calcium oxide, calcium carbonate, dolomite, and calcium containing waste.

* * * * *